United States Patent [19]

Witten et al.

[11] 4,274,330

[45] Jun. 23, 1981

[54] VENTILATOR AND MOUNTING FRAME ASSEMBLY

[75] Inventors: Alvin E. Witten; Howard W. Green, both of Gastonia, N.C.

[73] Assignee: Witten Automatic Vent Company, Inc., Gastonia, N.C.

[21] Appl. No.: 55,605

[22] Filed: Jul. 9, 1979

[51] Int. Cl.[3] ..... F24F 7/00

[52] U.S. Cl. ..... 98/37; 98/108; 98/114; 98/29; 248/27.1; 160/131

[58] Field of Search ..... 98/32, 29, 37, 108, 98/107, 110, 114, 121 R; 52/474, 208, 211, 212, 217, 475, 302, 303; 248/27.1

[56] References Cited

U.S. PATENT DOCUMENTS

| | | | |
|---|---|---|---|
| 1,995,764 | 3/1935 | Bohnsack | 52/211 |
| 2,203,311 | 6/1940 | Sinclair | 160/131 |
| 2,800,956 | 7/1957 | Xanten | 160/91 |
| 2,803,866 | 8/1957 | Flora | 248/27.1 |
| 3,308,746 | 3/1967 | Weiss | 98/108 |
| 3,528,606 | 9/1970 | Witten | 236/48 |
| 4,139,972 | 2/1979 | Naka | 52/217 |
| 4,175,480 | 11/1979 | Beam, Jr. et al. | 98/37 |
| 4,208,010 | 6/1980 | Beam, Jr. et al. | 236/49 |

*Primary Examiner*—Henry C. Yuen
*Attorney, Agent, or Firm*—Bell, Seltzer, Park and Gibson

[57] ABSTRACT

The mounting frame of the present invention is constructed for being easily installed in the wall of a building from the exterior side of the wall using only a simple hand tool, such as a screwdriver, and for slidingly receiving a ventilator in a quick and simple installation procedure. The mounting frame has an outwardly extending peripheral flange on the front thereof which is adapted to engage the exterior face of the wall, and includes clamping means extending rearwardly of the peripheral front flange for engaging the interior face of the wall and clamping the frame in place in the wall. Inwardly extending flanges on the top and bottom walls of the frame are provided for engaging the rear of the ventilator to limit rearward movement of the ventilator. The ventilator may be slidingly positioned in the opening formed by the frame and held in place with the rear of the ventilator engaging the inwardly extending flanges and with opposite ends of the ventilator being slidingly positioned behind the side walls of the frame to limit forward movement of the ventilator and thus hold the ventilator in place in the opening.

17 Claims, 8 Drawing Figures

VENTILATOR AND MOUNTING FRAME ASSEMBLY

FIELD OF THE INVENTION

The present invention relates to an improved arrangement for mounting a ventilator in the wall of a building. More particularly, this invention relates to a ventilator and mounting frame assembly constructed for quick and simple installation in a wall of a building.

BACKGROUND OF THE INVENTION

In buildings having enclosed spaces, such as enclosed foundation spaces, it is common practice to install ventilators in suitable openings in the building wall to provide a flow of ventilating air through the enclosed space. In foundation walls, foundation ventilators are required by building codes at spaced locations for moisture control among other reasons. Usually, such ventilators are preferably opened in the spring and closed in autumn to insure proper ventilation while minimizing heat loss during colder periods. In more recent times, temperature responsive foundation ventilators have been provided so as to assure opening and closing thereof at predetermined temperatures to provide optimum ventilation with minimum energy loss.

Typically, foundation ventilators are installed in the openings provided in the foundation wall by applying mortar around the perimeter of the ventilator once it is positioned in the opening. This method of installation is undesirable in many respects since the use of mortar is messy, involves time consuming preparation and clean-up, and requires a relatively high degree of skill. This method also results in a permanent installation and should it ever be necessary to remove the ventilator for any reason, such as for repair or replacement, the mortar must be chipped away from the opening using a hammer and chisel or other suitable tools. This process is not only laborious but frequently results in permanent damage to the ventilator being removed which frequently requires replacement of an otherwise repairable unit.

There has been at least one attempt to simplify the installation of temperature responsive ventilators by providing a mounting frame which can be installed without the use of mortar. However, this attempt has not proven successful as a solution to the aforementioned problems since this mounting frame must be secured in place by holes drilled in the building wall and by bolts and anchors with the temperature responsive ventilator being secured to the frame by rivets. As with prior installation methods, this mounting results in virtually a permanent installation which requires substantial skill and numerous tools to effect. Also, the removal of a ventilator once installed is difficult and time consuming and frequently requires replacement of both the mounting frame and the ventilator.

SUMMARY OF THE INVENTION

With the foregoing in mind, it is an object of the present invention to provide a mounting frame and ventilator assembly which overcomes these problems and by which the ventilator may be quickly and easily installed in a wall of a building.

In accordance with the present invention the mounting frame is constructed for being easily installed in the wall of a building from the exterior side of the wall using only a simple hand tool, such as a screwdriver, and for slidingly receiving the ventilator in a quick and simple installation procedure, which does not require tools or particular skills. More particularly, the frame has an outwardly extending peripheral flange on the front thereof which is adapted to engage the exterior face of the wall. The frame also includes clamping means extending rearwardly of the peripheral front flange for engaging the interior face of the wall and for clamping the wall between the front flange and the clamping means to secure the frame in place. The clamping means are so mounted as to be accessible for operation from the front of the frame. Thus, the frame may be readily installed in the wall from the exterior side thereof by positioning the frame in the opening and actuating the clamping means.

The mounting frame also includes means for retaining the ventilator within the opening defined by the frame. This retaining means preferably comprises inwardly extending flanges on the top and bottom walls of the frame with these flanges being spaced rearwardly from the rearmost portions of the side walls of the frame a sufficient distance to permit the grille portion of the ventilator to be received between these flanges and the side walls of the frame. Therefore, to install the ventilator in the frame, one end thereof is inserted into the opening with one end of the grille portion positioned behind one of the side walls of the frame until the other end of the ventilator clears the other side wall of the frame. The remainder of the ventilator may then be pushed rearwardly into the opening in the frame until the rear surface of the grille portion engages the inwardly extending flanges. The ventilator may then be moved laterally to position opposite end portions of the grille portion of the ventilator behind opposite side walls of the frame. Preferably, stops are provided on the grille portion of the ventilator to engage the inside surfaces of the side walls of the frame to maintain the ventilator in proper position. To remove the ventilator from the mounting frame, the above described installation procedure is reversed and the ventilator may be just as quickly and easily removed as it was installed.

BRIEF DESCRIPTION OF THE DRAWINGS

Some of the features and advantages of the invention having been stated, others will become apparent as the description proceeds, when considered in connection with the accompanying drawings, in which.

DESCRIPTION OF ILLUSTRATED EMBODIMENT

Figure 1:
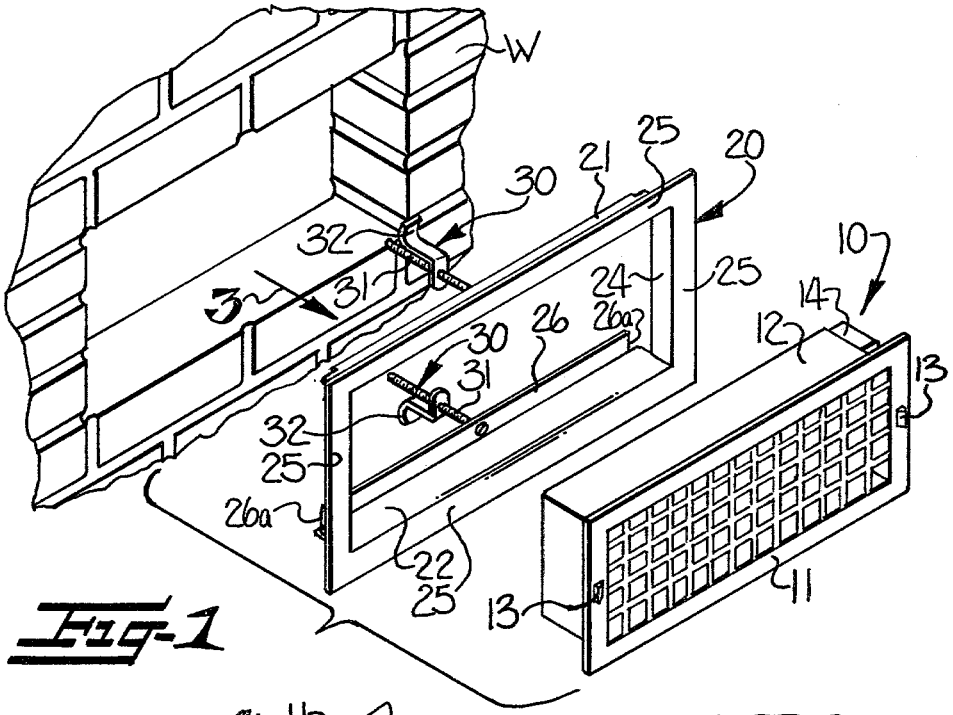
FIG. 1 is an exploded front perspective view showing the ventilator and cooperating mounting frame of the invention adapted for installation in a wall of a building.
Figure 2:
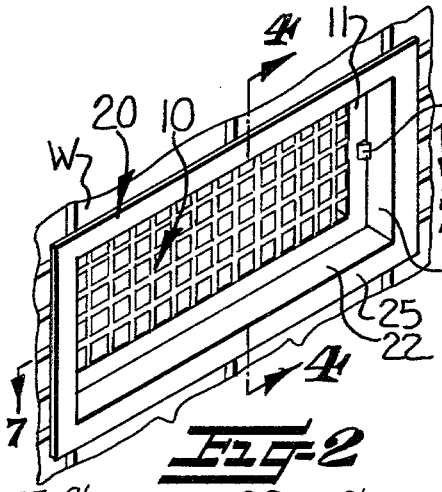
FIG. 2 is a front perspective view showing the ventilator and mounting frame as installed in the building wall.

Referring more particularly to the drawings, there is shown by way of illustration in FIG. 1 a foundation wall W formed of brick and having a rectangular opening therein in which a foundation ventilator is to be mounted. The foundation ventilator, indicated by reference character 10, is held in place in the foundation wall by a cooperating mounting frame 20.

The foundation ventilator 10 shown is of the type described in commonly owned Witten U.S. Pat. No. 3,528,606 in which a closure is provided which moves between an open and closed position in response to changes in ambient temperature conditions. However, the present invention is equally applicable for installing other types of ventilators, such as those having a manually operable closure or those not utilizing a closure. It should be further understood that while the ventilator 10 is referred to herein as a foundation ventilator for the ventilation of an enclosed foundation space, the present invention is also applicable to ventilators for use in providing ventilation in other enclosed spaces requiring ventilation.

Ventilator 10, more particularly, includes a generally rectangular front grille 11 and a housing 12 located rearwardly of the front grille and in which a set of shutters 12*a* (FIG. 7), serving as the closure mechanism, is located. A pair of stops 13 is provided on the front grille 11 for assisting in securing the ventilator in the mounting frame 20 as described more fully hereinafter. At one end of the housing 12 there is provided a small enclosure 14 which houses the temperature response actuator mechanism for actuating the shutters 12*a*.

As illustrated, the rectangular dimensions of the grille 11 are larger than those of the housing 12 so that the outer edges of the grille 11 project beyond the housing for a short distance. However, because of the enclosure 14 at one end of the housing, the grille projects further at one end than at the other end.

The frame 20 is of an open rectangular construction including generally horizontally extending top and bottom walls 21, 22 and opposing generally vertically extending side walls 23, 24, these walls collectively defining a rectangular opening of a predetermined size for receiving the rectangular ventilator grille 11.

The frame 20 includes an outwardly extending peripheral flange 25 at the front thereof which is adapted to engage the exterior face of the building wall W and limit inward movement of the frame while also covering any space between the opening in the wall and the frame to give a neat, finished appearance to the installation. As illustrated, the flange 25 is formed along the front edge of the respective walls 21, 22, 23 and 24.

Frame 20 also includes an abutment located rearwardly of the peripheral flange 25 and extending into the opening defined by the frame for engaging and limiting rearward movement of the ventilator 10 when installed in the frame. As illustrated, the abutment comprises an inwardly directed flange 26 formed on the upper and lower walls 21, 22 of the frame. The flange 26 is of such a height as to clear the housing 12 of the ventilator but to engage the inner surface of the grille 11.

Figure 3:
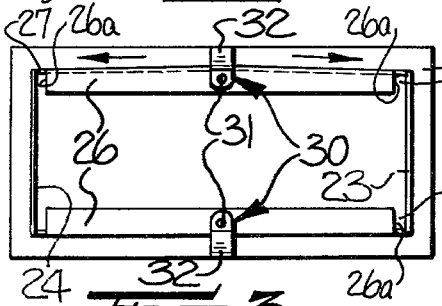
FIG. 3 is a rear view of the mounting frame as seen from the arrow 3 in FIG. 1.

Preferably, the lower wall 22 of frame 20 is provided with a slight slope toward the front of frame 20 for water drainage. Upper wall 21 is also desirably provided with a slight slope toward the front for drainage of any water which might run down the wall W and behind the flange 25 and to direct such water away from the ventilator housing 12. As seen in FIG. 3, the upper wall 21 may also be sloped downwardly toward opposite ends to also facilitate water drainage.

The frame 20 is held in place in the building wall W by adjustable clamping means extending rearwardly for engaging the interior face of the wall. As illustrated, the clamping means comprises a pair of adjustable fasteners 30 which are carried by the inwardly extending flange 26 and thus positioned so as to be covered by the ventilator grille 11 and hidden from view when the ventilator 10 is in position in the frame to thereby further enhance the finished appearance of the installation while also avoiding undesired tampering of the fasteners in the completed installation. The fasteners 30 are adjustable over a wide range so as to accommodate building walls of widely varying thickness.

Figure 4:
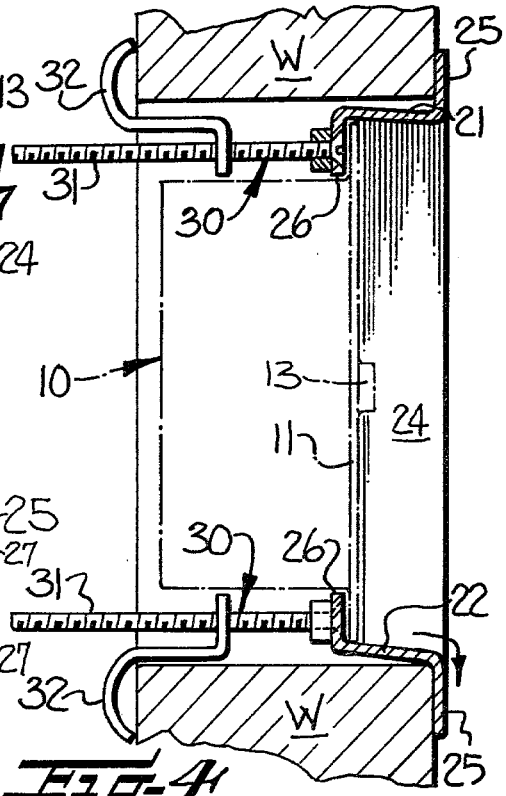
FIG. 4 is a cross-sectional view of the mounting frame taken substantially along the line 4—4 of FIG. 2.

As illustrated, each fastener 30 comprises an elongate threaded bolt 31 having a head located on the front side of flange 26 so as to be accessible for adjustment at the front of the frame and an elongate threaded shaft extending horizontally rearwardly through a suitable hole provided in the flange 26. A clamping member 32 of a generally hooklike J-shaped configuration is connected to the threaded shaft so as to be longitudinally adjusted when the bolt 31 is rotated. This is accomplished by threadably connecting the clamping member to the shaft by means of internal threads in the hole provided in the clamping member, or by means of a nut threaded onto the shaft behind the clamping member, or by other suitable means. As best seen in FIG. 4, the frame 20 is secured in place in the building wall W by positioning the clamping members 32 so as to extend outwardly and engage the interior face of the wall W and then rotating the bolts 31 so as to tighten the clamping members 32 against the interior face of the wall and to draw the peripheral flange 25 tightly against the exterior face of the wall W, thus clamping the wall between the flange 25 and the clamping members 32. While two fasteners 30 are illustrated, it will be understood that a different number of fasteners can be employed if so desired.

Once the frame has been mounted in place in the building wall in the manner described, the ventilator can be readily positioned in the opening formed by the frame and held in place by suitable means. In the preferred embodiment of the invention illustrated, the ventilator is slidingly held in place in the frame and is capable of being easily removed from the frame if so desired.

More particularly, it will be seen that the height dimension of the ventilator grille 11 corresponds substantially to the height of the opening in frame 20 while the width dimension of grille 11 is greater than the width dimension of the opening in frame 20. The inwardly extending flanges 26 which are provided on the top and bottom walls 21, 22 of the frame are located rearwardly of the rearmost portions of side walls 23, 24 a sufficient distance to enable opposite end portions of the ventilator grille 11 to be slidingly positioned behind the side walls 23, 24. When so positioned, the flanges 26 engage the rear surface of the grille 11 and serve to limit rearward movement of the ventilator, while the side walls 23, 24 engage the front surface of the grille 11 at opposite ends thereof and serve for engaging and limiting forward movement of the ventilator to thus hold the ventilator in place in the opening. The flanges 26 are of a length less than the width dimension of the opening with opposite ends 26*a* of the flanges being located inwardly of the side walls 24 to leave a space 27 adjacent to the side walls to facilitate slidingly maneuvering the ventilator into position during installation in the frame.

Figure 5:
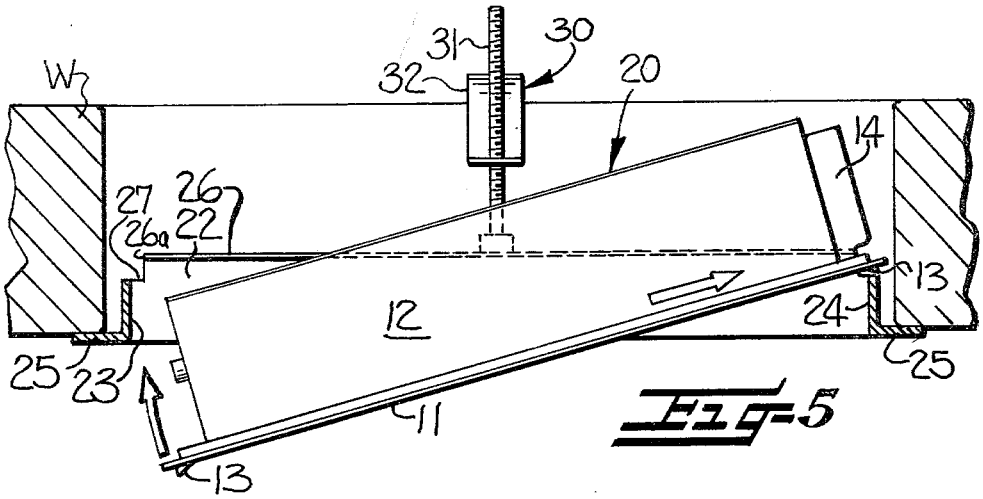
FIGS. 5 and 6 are views showing how the ventilator is installed in the mounting frame.
Figure 6:
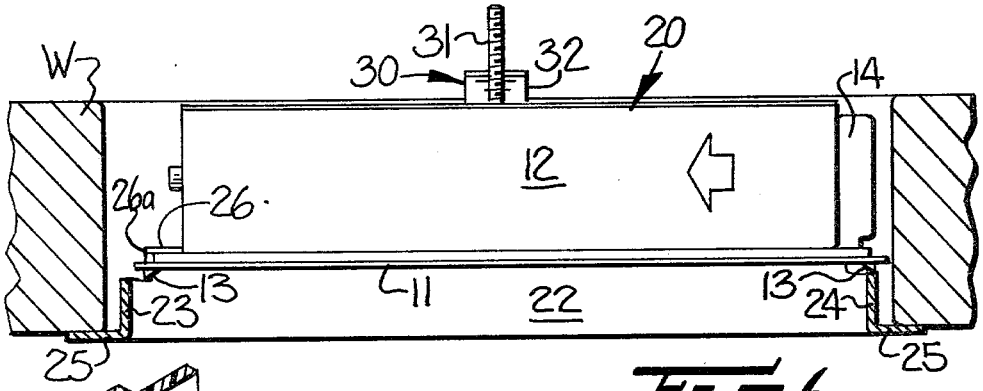
Figure 8:
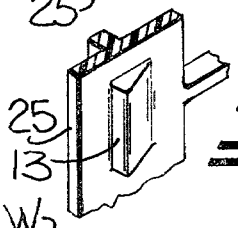
FIG. 8 is a fragmentary detailed view of one of the stops provided on the ventilator.
Figure 7:
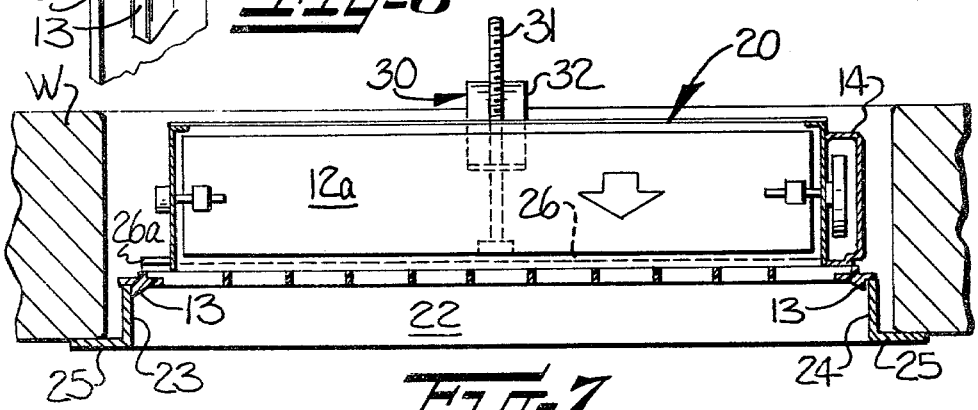
FIG. 7 is a sectional view taken along the line 7—7 of FIG. 2 and showing the ventilator as installed in the mounting frame.

As illustrated in FIGS. 5–7, the ventilator is readily installed in the frame by inserting one end of the ventilator into the opening with the grille 11 located between the top and bottom walls 21, 22 and behind one of the side walls 24 to enable the opposite end of the grille to clear the opposite side wall 23. Preferably, and as illustrated, the end of the ventilator having the housing 14 is inserted first into the frame (FIG. 5).

The ventilator may then be pushed rearwardly until the rear surface of the grille 11 engages the flanges 26. The ventilator may then be moved laterally (to the left as indicated by the arrow in FIG. 6) to center the ventilator in the opening and to position opposite end portions of the grille 11 behind opposite side walls 23, 24 of the frame.

The ventilator is then moved forwardly as indicated by the arrow in FIG. 7. As illustrated, forwardly projecting stops 13 are formed on the front surface of the grille 11, the stops being spaced apart a distance corresponding to the width dimension of the opening so that the stops will engage the inside surfaces of the side walls 23, 24 to thus assist in maintaining the ventilator in proper position in the opening. To remove the ventilator from the mounting frame, the above-described procedure is reversed and the ventilator can be just as quickly and easily removed from the frame as it was installed.

It will thus be seen that the present invention provides a ventilator and mounting frame assembly of relatively simple and inexpensive construction which enables a ventilator to be quickly and easily installed in a wall of a building with the use of a simple hand tool and without requiring access to the interior side of the building wall.

In the drawings and specification there has been set forth a preferred embodiment of the invention, and although specific terms are employed, they are used in a generic and descriptive sense only and not for purposes of limitation.

What is claimed is:

1. A ventilator and mounting frame assembly constructed for quick and simple installation in a wall of a building and comprising a frame adapted to be mounted in the building wall from the exterior side of the wall, said frame comprising respective opposing pairs of interconnected generally horizontal and generally vertical walls defining an opening of predetermined size, and said frame having an outwardly extending peripheral flange at the front thereof adapted to engage the exterior face of the wall and having clamping means extending rearwardly of said peripheral flange for engaging the interior face of the wall and clamping the frame in place in the wall, a ventilator positioned in the opening of said frame, respective abutment means carried by one of said pairs of walls and extending inwardly into said opening and engaging the rear of said ventilator to limit rearward movement of the ventilator, said abutment means being located rearwardly of the other of said pair of walls and said ventilator being slidingly positioned in the opening with opposite ends of the ventilator located behind said other walls for engaging and limiting forward movement of the ventilator and thus holding the ventilator in place in the opening.

2. An assembly as set forth in claim 1 wherein said abutment means comprise respective inwardly extending flanges carried by said one pair of walls and extending inwardly into said opening in opposing relation to one another.

3. An assembly as set forth in claim 1 wherein said clamping means is mounted to said frame so as to be accessible for operation from the front of the frame.

4. An assembly as set forth in claim 1 wherein said clamping means comprises a plurality of elongate threaded bolts rotatably carried by said frame and extending rearwardly therefrom, each bolt having means at one end thereof accessible from the front of the frame for engagement and rotation by an adjustment tool, and a clamping member carried by each of said bolts for being longitudinally adjusted therealong upon rotation of the bolt to bring the clamping member into engagement with the interior face of the building wall.

5. A ventilator and mounting frame assembly constructed for quick and simple installation in a wall of a building and comprising a frame adapted to be mounted in the building wall from the exterior side of the wall, said frame comprising interconnected generally horizontal top and bottom walls and generally vertical side walls defining a rectangular opening of predetermined height and width, said frame having an outwardly extending peripheral flange at the front thereof adapted to engage the exterior face of the building wall and including clamping means extending rearwardly of said peripheral flange for engaging the interior face of the building wall and securing the frame in place in the wall, a pair of opposing inwardly extending flanges carried respectively by said top and bottom walls and located rearwardly of said side walls and extending inwardly into the opening of said frame, and a ventilator having a rectangular grille of a height corresponding to the height dimension of said opening and of a width greater than the width dimension of said opening, the rear surface of said grille engaging said inwardly extending flanges for limiting rearward movement of the ventilator, and opposite end portions of said grille being slidingly positioned behind said side walls for engaging and limiting forward movement of the ventilator and thus holding the ventilator in place in the opening.

6. An assembly as set forth in claim 5 wherein the front surface of said grille includes a pair of stops located at opposite ends of the grille and projecting forwardly for engaging the interior surface of said side walls and assisting in maintaining the grille properly positioned in the opening.

7. An assembly as set forth in claim 5 wherein said opposing inwardly extending flanges are of a length less than the width dimension of said opening with opposite ends of the flanges being located inwardly of said side walls to leave a space adjacent to said side walls to facilitate slidingly maneuvering the ventilator into position during installation in said frame.

8. An assembly according to claim 5 wherein said clamping means are carried by said inwardly extending flanges so as to be covered by said ventilator and hidden from view when the ventilator is in position in the opening.

9. An assembly according to claim 5 wherein said clamping means comprise a plurality of elongate threaded bolts carried by said inwardly extending flanges so as to be covered by said ventilator and hidden from view when the ventilator is in position in the opening, each bolt having a head located on the front side of said flange and accessible for engagement and rotation by an adjustment tool, and having a horizontally extending threaded shaft on the rear side of the flange, and a clamping member carried by each of said bolts for being longitudinally adjusted upon rotation of the bolt to bring the clamping member into engagement with the interior face of the building wall.

10. An assembly according to claim 5 wherein said bottom wall of said frame is sloped toward the front of the frame to provide for water drainage.

11. An assembly according to claim 10 wherein said top wall of said frame is also sloped toward the front of the frame to provide for water drainage.

12. A mounting frame for a ventilator constructed for quick and simple installation of the ventilator in a wall of a building from the exterior side of the wall, said frame comprising respective opposing pairs of interconnected generally horizontal and generally vertical walls defining an opening of predetermined size, said frame having an outwardly extending peripheral flange at the front thereof adapted to engage the exterior face of the building wall and having clamping means extending rearwardly of said peripheral flange for engaging the interior face of the wall and clamping the frame in place in the wall, respective abutment means carried by one of said pairs of walls and extending inwardly into said opening and adapted for engaging the rear of a ventilator positioned in the opening to limit rearward movement of the ventilator, and said abutment means being located rearwardly of the other of said pairs of side walls a sufficient distance to permit the ventilator to be slidingly positioned in the opening with the rear of the ventilator engaging said abutment means and with opposite ends of the ventilator located behind said other walls to limit forward movement of the ventilator and thus hold the ventilator in place in the opening.

13. A frame according to claim 12 wherein said abutment means comprise respective inwardly extending flanges carried by said one pair of walls and extending inwardly into the opening in opposing relation to one another.

14. A frame according to claim 12 wherein said clamping means is mounted to said frame so as to be accessible for operation from the front of the frame.

15. A frame according to claim 12 wherein said clamping means comprises a plurality of elongate threaded bolts rotatably carried by said frame and extending rearwardly therefrom, each bolt having means at one end thereof accessible from the front of the frame for engagement and rotation by an adjustment tool, and a clamping member carried by each of said bolts for being longitudinally adjusted therealong upon rotation of the bolt to bring the clamping member into engagement with the interior face of the building wall.

16. A mounting frame for a ventilator constructed for quick and simple installation of the ventilator in a wall of a building from the exterior side of the wall, said frame comprising interconnected generally horizontal top and bottom walls and generally vertical side walls defining a rectangular opening of predetermined height and width, said frame having an outwardly extending peripheral flange at the front thereof adapted to engage the exterior face of the building wall and including adjustable clamping means extending rearwardly of said peripheral flange for engaging the interior face of the building wall and securing the frame in place in the wall, a pair of opposing inwardly extending flanges carried respectively by said top and bottom walls and located rearwardly of said side walls a sufficient distance to permit a ventilator to be slidingly positioned in the opening with the rear of the ventilator engaging said opposing inwardly extending flanges and with opposite end portions of the ventilator located behind said walls to thus hold the ventilator in place in the opening.

17. A frame according to claim 16 wherein said opposing inwardly extending flanges are of a length less than the width dimension of said opening with opposite ends of the flanges being located inwardly of said side walls to leave a space adjacent to said side walls to facilitate slidingly maneuvering a ventilator into position during installation in the frame.

* * * * *